United States Patent [19]

Andersson

[11] B 3,993,287

[45] Nov. 23, 1976

[54] METHOD AND DEVICE OF REBLOCKING TO AN INCREASED OR REDUCED NUMBER OF ROPE PARTS AT A HOISTING GEAR

[75] Inventor: Rickard Andersson, Vasteras, Sweden

[73] Assignee: Linden-Alimak AB, Vasteras, Sweden

[22] Filed: Jan. 29, 1974

[21] Appl. No.: 437,559

[44] Published under the second Trial Voluntary Protest Program on February 3, 1976 as document No. B 437,559.

[30] Foreign Application Priority Data

Feb. 9, 1973 Sweden ..... 7318228

[52] U.S. Cl. ..... 254/188; 212/102

[51] Int. Cl.[2] ..... B66D 3/04

[58] Field of Search ..... 254/188, 189, 190, 192, 254/193, 194, 195, 196, 139; 105/163; 104/98; 212/100, 101, 102, 106

[56] References Cited

UNITED STATES PATENTS

| | | | |
|---|---|---|---|
| 308,275 | 11/1884 | Oborn | 212/102 |
| 466,090 | 12/1891 | Brown | 254/188 |
| 3,306,469 | 2/1967 | Durand | 254/188 |
| 3,620,504 | 11/1971 | Morrison | 254/188 |

FOREIGN PATENTS OR APPLICATIONS

| | | | |
|---|---|---|---|
| 171,531 | 10/1965 | U.S.S.R. | 212/102 |

*Primary Examiner*—Robert J. Spar
*Assistant Examiner*—Kenneth Noland
*Attorney, Agent, or Firm*—Fred Philpitt

[57] ABSTRACT

In a lifting gear comprising a lifting cable and two blocks, e.g. the upper trolley block and the lower hook block, respectively, of a hoisting crane, the number of cable parts, in which the lower block is hanging, is changed, in order to increase or decrease the lifting capacity, by means of a cable catching means being arranged on the lower block, which catching means is capable of catching (or disengaging) a cable part running horizontally in the upper block, which cable part is pulled down as two further parts with the catching means and at ground level laid under a further rope pulley of the lower block. Reblocking to fewer cable parts is carried out in the reverse order.

7 Claims, 6 Drawing Figures

METHOD AND DEVICE OF REBLOCKING TO AN INCREASED OR REDUCED NUMBER OF ROPE PARTS AT A HOISTING GEAR

This invention relates to a method and a device of reblocking to an increased or reduced number of rope parts at a hoisting gear comprising a lifting cable, an upper block means and a lower block means hanging there under in at least two rope parts of the lifting cable, the upper block means being provided with at least two rope pulleys, between which one part of the lifting cable is running at the level of the upper block means.

The invention is for instance suitable for use in building activity where the lifting needs can be of a very different kind, e.g. lifting of heavy as well as light elements.

One field of application of the invention is hoisting devices, where the load is carried by lifting cables hanging from a trolley travelling along a crane jib or a crane bridge. The hoist machinery is usually positioned stationarily in the vicinity of one end of the track of the trolley. The lifting cable is pulled out of the hoist machinery and is passed over one or more pulleys located at the opposite end of the track, further back over a pulley in an upper block of the trolley, under one or more pulleys in a lower block and over a second pulley in the upper block. The lifting cable is then drawn towards the hoist machinery, after which the end of the rope is anchored.

By such cable arrangements the vertical position of the load is not influenced when the trolley is moved along its track.

The load is usually lifted in four rope parts instead of two by passing the lifting cable over another pulley located in the lower block of the hoisting gear or in its upper block. In the same way it is achieved that the load is lifted in six rope parts by the lifting cable being guided over another two pulleys placed in a lower block or an upper block.

Especially at high tower cranes such a reblocking of lifting cables is often time-consuming and moreover dangerous.

In order to eliminate these risks and disadvantages several attempts for improvements have been made in recent years. Solutions are known from e.g. French patent 1.557.844, at which cable reblocking can be carried out from the ground. However, the known devices of this kind have certain disadvantages. They are built on the principle that a third rope pulley block loaded with weights has been hung on the lifting cable between two pulleys mounted in the upper block. On slacking the lifting cable, which is done after the lower block has been lowered to the ground, the rope pulley block hung loosely to the upper block will be lowered towards the lower block on the ground. The lowered rope pulley block is anchored to the lower block at the ground plane.

The required tare weight of a rope pulley block hung in this way is usually about 90–100 kg to overcome stiffness of cables and losses in pulleys. It is easily realized that there is a great risk e.g. at a rupture of the cable. The rope pulley blocks being hung loosely to the upper block on the lifting cable will fall freely to the ground.

However, in addition to said security risks such systems have also other disadvantages. The relatively heavy, loose rope pulley blocks are also difficult to handle from the ground plane and also cause a not inessential corresponding reduction of the useful lifting capacity. Due to i.a. the above-mentioned security risks and disadvantages, which to a large extent are caused by the necessary weight of the loose rope pulley block, one has instead placed a loose rope pulley block under the lifting cable in the lower block between rigidly mounted pulleys. A change from a load in two rope parts to a load in four rope parts is effected by pulling in the lifting cable until the lower block gets in contact in its highest position with the upper block. In that position the rope pulley block loosely resting in the lower block is anchored to the upper block. At a following lowering motion the lower block will hang in four rope parts. The advantage of this system as compared with the previous ones is that the loose rope pulley block need not be extra loaded with weights. However, one disadvantage is that the necessary reblocking must be made at a considerable height over the ground plane e.g. at tower cranes. One restriction is also that reblocking to a load in six rope parts cannot take place in a corresponding way.

Using the above-mentioned main principles a great number of varying constructional solutions occur, which however all have one or other of said disadvantages.

The said disadvantages at known hoisting gears are essentially removed by the method and device of the present invention by their being provided with the characteristic features defined in the claims. A change from two to four or six rope parts can be carried out in a comfortable and secure manner from the ground. Reblocking is made by increasing the number of pulleys in the lower block only. On reblocking the hook block is provided with a rope catching device, which after accomplished reblocking can be removed again. Rope pulley blocks placed loosely at the upper block are not used, and in this way a fracture on the rope cannot cause a free fall of a rope pulley block, either.

An illustrative example of the invention will now be described in connection with the enclosed drawing, in which FIG. 1 is a perspective view of a crane jib with a trolley and a hook block hanging in two rope parts, which is shown reblocked to additionally four rope parts with a dashed line.

Figure 1:
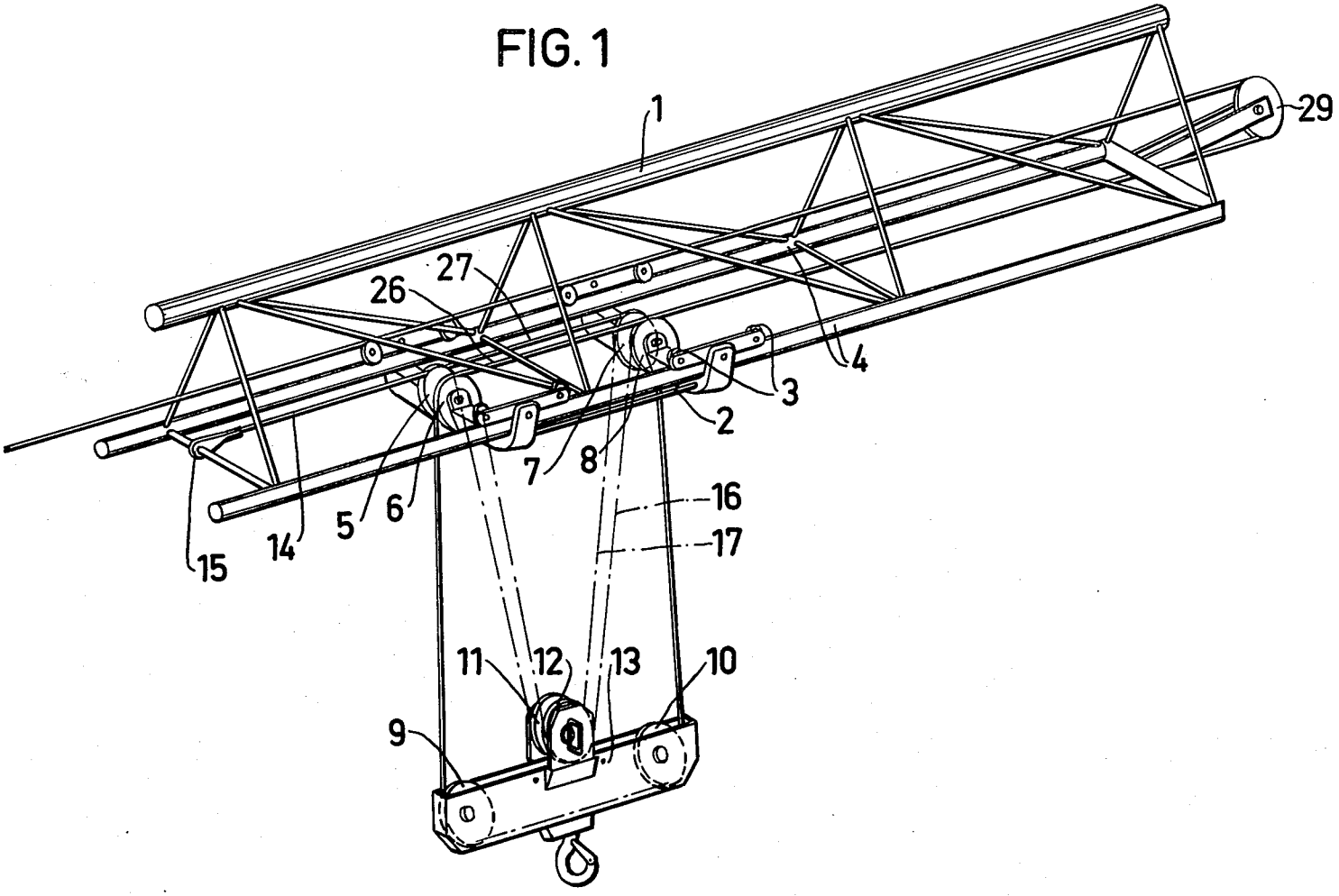
Figure 2:
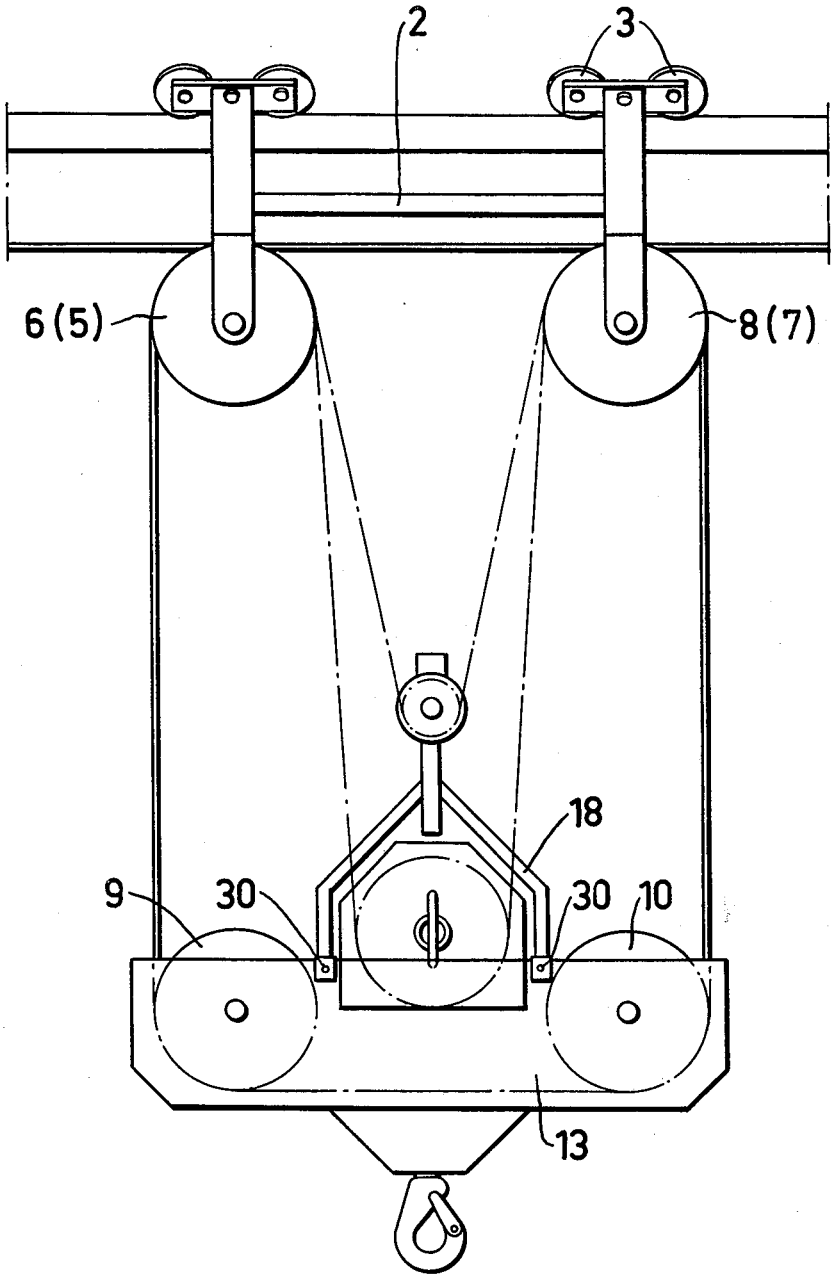
FIG. 2 is a side view of the trolley in FIG. 1 with a hook block hanging under this, which is adapted with a rope catching device for reblocking of the lifting cable.

The outer part of a crane jib, on which a trolley 2 is movable in the longitudinal direction of the crane jib, is designated by the numeral 1. The trolley is provided with travelling wheels 3, which roll on the lower frame rods 4 of the crane jib. Pulleys 5, 6, 7 and 8, together forming the upper block of the hoisting gear, are mounted on the trolley. Pulleys 9, 10, 11 and 12 are mounted in a rope pulley block 13 with a hook and constitute together the lower block of the hoisting gear. The lifting cable 14 is anchored to the crane jib 1 with a rope attachment 15. The lifting cable 14 runs over a pulley 5, is passed over a pulley 7 in the upper block, is further brought over the pulleys 10 and 9 in the lower block, over the pulleys 6 and 8 in the upper block and are passed over a pulley 29 at the end of the crane jib. Then the lifting cable is brought back in the longitudinal direction of the crane jib to a suitable hoist machinery, which, however, is not shown in the figure. In order that the extension of the lifting cable should appear more clearly, cables and travel machinery for the motion of the trolley in the longitudinal direction of the crane jib have not been drawn.

Reblocking for lifting in four line parts is carried out by one part 27 of the lifting cable located between the pulleys 5 and 7 or one part 26 between the pulleys 6 and 8 in the upper block being pulled down over one of the pulleys 11 or 12 in the lower block. Reblocking for a lift in six rope parts is achieved by drawing down the rope part 27 and the rope part 26 in the upper block over the pulleys 11 and 12 in the lower block. The extension of the lifting cable in this case is apparent from the dotted and dashed lines 16 and 17.

When it is intended to reblock the lifting cable from e.g. a load in two rope parts to a load in four rope parts, a rope catching device 18 is attached to the hook block 13 by means of cotters 30. This is made with rope rejecting guides 19 and 20, a pulley 21, a rope rejecting stud 22 and a latching means 23, the latter being actuated by a tension spring 24. By manual turning of the latching means 23 around a shaft 25 the latching means 23 can be brought to remain in inactive position, which is shown in FIG. 3, or in connected position, which is shown in FIG. 4 and 5.

Figure 3:
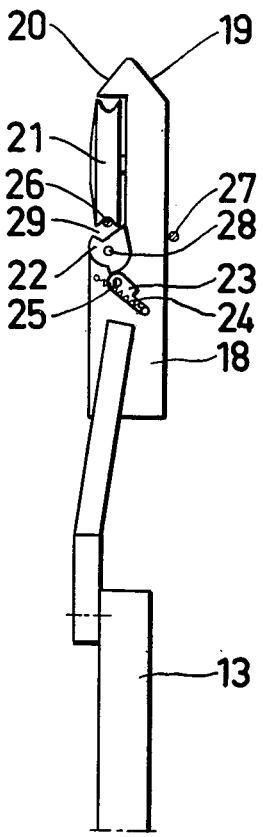

At FIG. 3 the hook block 13 is hoisted to a position in close connection with the trolley 2. The rope rejecting guides 19 and 20 of the rope catching device have under the influence of the upward motion of the hook block been forced upwards between the two horizontally running rope parts 26 and 27. The rope part 26 has in the figure passed through an opening 29 and taken a position on the pulley 21, after which the hook block can again be lowered to the ground plane. During the lowering motion a rope coil is simultaneously pulled down, which is transferred manually at the ground plane to a pulley 12, which is mounted in the hook block 13.

Figure 4:
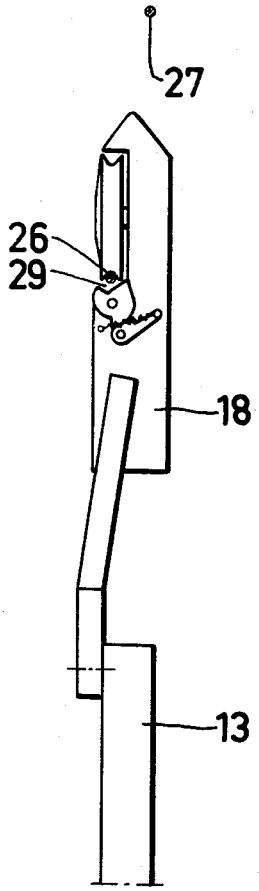
Figure 5:
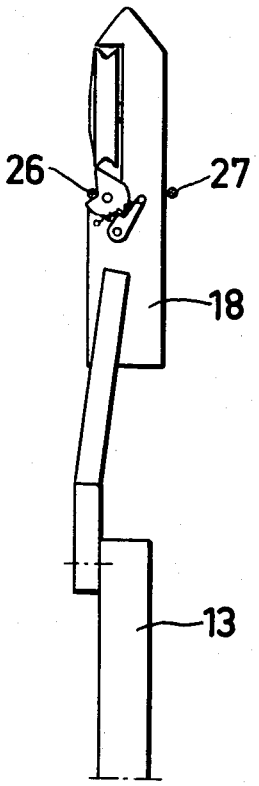

If it had been intended instead to reblock from e.g. four rope parts to two rope parts, the latching means 23 is first switched to the position shown in FIG. 4. The lifting cable is transferred from either of the rope discs 11 or 12 to the pulley 21 of the cable catching device 18, after which the hook block is hoisted. Then the rope coil from the rope 26 will be successively reduced until the rope is quite horizontal between the pulleys in the upper block. The hoisting motion of the hook block is however continued. The contact between the cable 26 and pulley 21 will then cease, after which the rope gets into contact with the cable rejecting stud 22 instead, which will be rotated around its axis 28 under the influence of a force from the cable. The rotation is continued until a latched position, which is apparent from FIG. 5. The rope rejecting stud 22 is made so that the opening 29 to the groove in the pulley 21 will be blocked at the same time as the cable has been moved out of the cable groove. Then the hook block 13 can be lowered.

Figure 6:
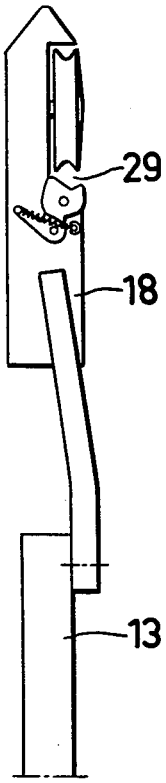
FIGS. 3, 4, 5 and 6 are side views of the rope catching device according to FIG. 2 on a larger scale during different moments of the reblocking procedure.

When it is intended to reblock from a load in four cable parts to a load in six cable parts or vice versa the cable catching device 18, see FIG. 6, is turned 180° to the opposite side of the hook block 13, after which the same measures as described for blocking from a load in two to a load in four rope parts, or inversely, are carried out.

However, the invention is not restricted to the use of two, four or six rope parts but can be used with every desired, even number of rope parts. For this only the number of pulleys in upper blocks and lower blocks respectively need be changed. The cable catching device is made so that it can be attached in suitable displaced positions to grip a desired rope part.

In the illustrative example reblocking takes place in two steps, i.e., catching and pulling down the extra rope parts and then placing these under a pulley of the lower block.

Without deviating from the inventive thought it is also possible, after lifting of the lower block to the upper block to have the extra rope parts pass directly by means of suitable guide means to a permanent pulley arranged on the lower block in suitable manner.

Moreover, without deviating from the inventive thought several cable catching devices can be used simultaneously for pulling down two or several cable parts at the same time from the upper block.

What is claimed is:

1. A method of reblocking a hoisting gear to a different number of cable parts, said hoisting gear including a lifting cable, an upper block means and a lower block means hanging under the upper block means in at least two rope parts of the lifting cable, the upper block means having at least two spaced apart pulleys, between which one part of the lifting cable runs on the same level as the upper block means, characterized in that the lower block means is lifted up to the upper block means and a portion of the cable running between said two spaced apart pulleys is engaged by a cable engaging means attached to the lower block means and also characterized in that the lifting cable pulled down between said two pulleys on said upper block means is moved manually from said engaging means and placed around a special pulley of the lower block means in reblocking to more cable parts and that the reverse procedure is used in reblocking to fewer cable parts.

2. The method of claim 1 characterized in that said special pulley is loose when the lifting cable is placed around it and that it is mounted in the lower block means after applying the lifting cable.

3. A load-hoisting tackle arrangement comprising in combination:

a. a lifting cable;

b. upper block means having at least two pulleys over which one part of said lifting cable runs on the same level as the upper block means, c. lower block means including at least one pulley over which said lifting cable runs, said lower block means hanging under said upper block means, and d. cable engaging means associated with said lower block means that is arranged to periodically engage a portion of the cable that extends between two pulleys on said upper block means when said lower block means is raised to a position close to said upper block means, said engaging means having an upwardly directed head with a recess in at least one side for engaging the cable and at least one upper inclined surface, which on engagement is intended to meet the lifting cable and to guide said recess over the cable together with one side of the upper portion of the head.

4. An arrangement according to claim 3 characterized in that the engaging means is mounted so as to get into a position for pulling down additional cable coils by turning 180° relative to the lower block means.

5. An arrangement according to claim 3 which additionally includes another pulley mounted on the lower block means which is adapted to engage the lifting cable pulled down between said two pulleys of the upper block means.

6. An arrangement according to claim 3 wherein said recess has automatic latching means which permits the passage of the cable into the recess but which upon an upwardly directed motion of the head expels the cable from the recess so that the cable can resume its original position in the upper block means and so that the engaging means and the lower block means can be lowered again without bringing the cable along.

7. A load hoisting arrangement comprising in combination a. upper block means that is part of a trolley movable along the jib of a tower crane, b. lower block means located beneath said upper block means, c. said upper block means including two pairs of spaced apart pulleys, d. said lower block means including two pulleys that are spaced apart at approximately the same distance as said two pairs of pulleys on said upper block means are spaced apart, e. a third pulley mounted on said lower block means at a point intermediate said two pulleys, f. a lifting cable that extends over two spaced apart pulleys in the upper block means, under said two pulleys of said lower block means and then up and over the other two pulleys of said upper block means, g. cable engaging means associated with said lower block means that extends above all of said pulleys on said lower block means and which is arranged to periodically engage a portion of the cable that extends between two of the spaced apart pulleys on said upper block means when said lower block means is raised to a position close to said upper block means so that said engaged cable can be run under said third pulley.

* * * * *